US005950443A

United States Patent [19]

Meyer et al.

[11] Patent Number: 5,950,443

[45] Date of Patent: Sep. 14, 1999

[54] COMPRESSOR MINIMUM CAPACITY CONTROL

[75] Inventors: Jonathan M. Meyer, Onalaska; Ronald W. Okoren, Holmen; Lee L. Sibik, Onalaska; Daniel C. Leaver; Sean A. Smith, both of La Crosse, all of Wis.

[73] Assignee: American Standard Inc., Piscataway, N.J.

[21] Appl. No.: 08/910,957

[22] Filed: Aug. 8, 1997

[51] Int. Cl.[6] ..... F25B 1/00

[52] U.S. Cl. ..... 62/228.5; 62/228.4; 62/209; 62/213; 417/32; 417/292

[58] Field of Search ..... 62/228.4, 228.5, 62/208, 209, 213, 115; 417/32, 292

[56] References Cited

U.S. PATENT DOCUMENTS

| | | | |
|---|---|---|---|
| 4,042,310 | 8/1977 | Schibbye et al. . | |
| 4,351,160 | 9/1982 | Kountz et al. . | |
| 4,412,788 | 11/1983 | Shaw et al. . | |
| 4,502,833 | 3/1985 | Hibino et al. . | |
| 4,516,914 | 5/1985 | Murphy et al. . | |
| 4,538,421 | 9/1985 | Kawamoto . | |
| 4,548,549 | 10/1985 | Murphy et al. . | |
| 4,689,967 | 9/1987 | Han et al. | 62/228.5 X |
| 4,743,170 | 5/1988 | Marshall . | |
| 4,850,200 | 7/1989 | Sugiyama | 62/228.4 X |
| 4,895,000 | 1/1990 | Takahashi | 62/228.5 X |
| 4,909,716 | 3/1990 | Orosz et al. . | |
| 4,913,634 | 4/1990 | Nagata et al. . | |
| 5,027,608 | 7/1991 | Rentmeester et al. . | |
| 5,044,894 | 9/1991 | Field et al. . | |
| 5,081,876 | 1/1992 | Marshall . | |
| 5,183,395 | 2/1993 | Langouet . | |
| 5,200,872 | 4/1993 | D'Entremont et al. | 361/25 |
| 5,203,685 | 4/1993 | Andersen et al. . | |
| 5,211,026 | 5/1993 | Linnert . | |
| 5,257,921 | 11/1993 | Clarke et al. . | |
| 5,295,362 | 3/1994 | Shaw et al. . | |
| 5,368,446 | 11/1994 | Rode | 417/32 X |
| 5,419,146 | 5/1995 | Sibik et al. . | |
| 5,509,273 | 4/1996 | Lakowske et al. . | |
| 5,586,445 | 12/1996 | Bessler . | |
| 5,600,960 | 2/1997 | Schwedler et al. . | |
| 5,632,154 | 5/1997 | Sibik et al. . | |

*Primary Examiner*—Henry Bennett
*Assistant Examiner*—Marc Norman
*Attorney, Agent, or Firm*—William J. Beres; William O'Driscoll; Peter D. Ferguson

[57] ABSTRACT

A method of controlling compressor minimum capacity. The method comprises the steps of: measuring a first condition; comparing the first condition to a first setpoint to determine a first conditioned error; modulating compressor capacity relative to the first condition error; measuring a second condition; comparing the second condition to a second setpoint to determine a second condition error; and modulating compressor capacity relative to the second condition error if the magnitude of the second conditioned error is greater than the magnitude of the first conditioned error.

12 Claims, 2 Drawing Sheets

COMPRESSOR MINIMUM CAPACITY CONTROL

BACKGROUND OF THE INVENTION

The present invention is directed to a compressor minimum capacity controller which controls the minimum capacity of a compressor. Specifically, the minimum capacity controller is implemented as a software slide valve stop for a helirotor compressor, but is not intended to be so limited. Rather, the invention is intended to be applicable to all variable capacity compressors having minimum capacity limits.

Specifically referring to helirotor or screw compressors, these compressors become less efficient as their load decreases. Increased internal compressor temperatures are the result of this lowered efficiency. At either low evaporator and/or high condenser temperatures, the internal compressor temperatures increase even more. A combination of low load, low evaporator temperatures, and/or high condenser temperatures will increase rotor temperatures such that protection or minimum capacity limiting is necessary to avoid damage to the compressor. Without such a minimum capacity limit, the unloading of the compressor at these conditions leads to overheating of the compressor rotors and the radial expansion or radial growth of the rotors. This radial growth results in a radial rub with the compressor housing, subsequently causing a failure.

In order to avoid compressor failure under extreme conditions, previous systems have installed a physical slide valve stop, also called a puck or a hockey puck, to set a minimum load based on the anticipated operating conditions of the customer's applications. However and unfortunately, a single mechanical stop is not optimum for all operating conditions, a single mechanical stop does not compensate for changes in the system design after original installation, and a single mechanical stop does not compensate for operator error in sizing the mechanical stop. A minimum capacity limit controller is desirable that will automatically adjust the compressor at minimum load for contemporaneous conditions, allowing the screw compressor system to adapt to variable operating conditions.

The simplest approach would be to measure the rotor temperature itself and establish a minimum capacity limit based upon that measured temperature. However, measuring the rotor temperature directly is difficult to implement without significant cost and operating efficiency penalties. A substitute measure for rotor temperature, such as compressor refrigerant discharge temperature is preferred. The present invention proposes a minimum capacity limit control that will control the compressor refrigerant temperature by limiting unloading, suspending loading, or initiated forced loading of the compressor responsive to a measured condition where the measured condition is directly related to rotor temperature.

SUMMARY OF THE INVENTION

In the present invention, the minimum capacity limit control is embedded within a microprocessor using a proportional integral derivative algorithm to maintain reverse conditions such as leaving water temperature at a first setpoint. The difference between the first condition and the first setpoint is a first condition error used by the PID algorithm as a basis for control.

The present invention uses measured compressor refrigerant discharge temperature as a substitute measure for the compressor rotor temperature. This measured compressor refrigerant discharge temperature is compared to a second conditioned setpoint to determine a second condition error. An error arbitrator passes the larger of the first and second conditioned errors to the PID control algorithm. Effectively, any time the compressor refrigerant discharge temperature error is greater than the chilled water error, the minimum capacity limit becomes the dominant control objective and leaving water temperature control is in abeyance.

It is an object, feature and advantage of the present invention to solve the problems of the prior art.

It is an object, feature and advantage of the present invention to provide a minimum capacity limit for a compressor where the minimum capacity limit does not rely on a mechanical stop.

It is an object, feature and advantage of the present invention to provide a minimum capacity limit for a compressor where the minimum capacity limit functions based on a substitute measure of compressor rotor temperature.

It is a further object, feature and advantage of the present invention that the substitute measure for compressor rotor temperature be the compressor refrigerant discharge temperature.

The present invention provides a method of controlling compressor minimum capacity. The method comprises the steps of: measuring a first condition; comparing the first condition to a first setpoint to determine a first conditioned error; modulating compressor capacity relative to the first condition error; measuring a second condition; comparing the second condition to a second setpoint to determine a second condition error; and modulating compressor capacity relative to the second condition error if the magnitude of the second conditioned error is greater than the magnitude of the first conditioned error.

The present invention also provides a method of controlling compressor capacity in a compressor having a rotor. The method comprises the steps of: measuring a temperature representative of the compressor rotor temperature; comparing the measured temperature to a setpoint to determine an error; and controlling the capacity of the compressor responsive to the magnitude of the error.

The present invention further provides a system. The system comprises: a compressor operable to compress a cooling fluid; a heat exchanger operably connected to the compressor to receive the cooling fluid and place the cooling fluid in heat exchange relationship with a process fluid; and a controller, operably connected to the compressor, and controlling the compressor capacity responsive to a first error associated with a first measured condition of the process fluid. The controller is responsive to the first error unless a second error associated with a second measured condition of the cooling fluid exceeds the first error; in such eventuality, the compressor capacity is modulated responsive to the second error.

The present invention still further provides an air conditioning or refrigeration system. The system comprises: a compressor having a variable capacity and a minimum capacity, and including an inlet and an outlet; a condenser operably connected to the compressor outlet; an expansion valve operably connected to the condenser; and an evaporator operably connected to the expansion valve and connected to the compressor inlet. The system also includes a first sensor operably associated with the evaporator and measuring the temperature of a first fluid being conditioned by the evaporator; a second sensor associated with the compressor outlet and measuring a temperature representative of compressor refrigerant discharge temperature; and a controller, operably connected to the compressor and to the first and second sensors, for varying compressor capacity to maintain a predetermined temperature associated with the first fluid. The controller varies compressor capacity to maintain the predetermined temperature unless the compressor refrigerant discharge temperature measured by the second sensor indicates that the minimum compressor capacity will be violated whereupon the controller controls the compressor capacity response to the refrigerant discharge temperature.

DETAILED DESCRIPTION OF THE DRAWINGS

Figure 1:
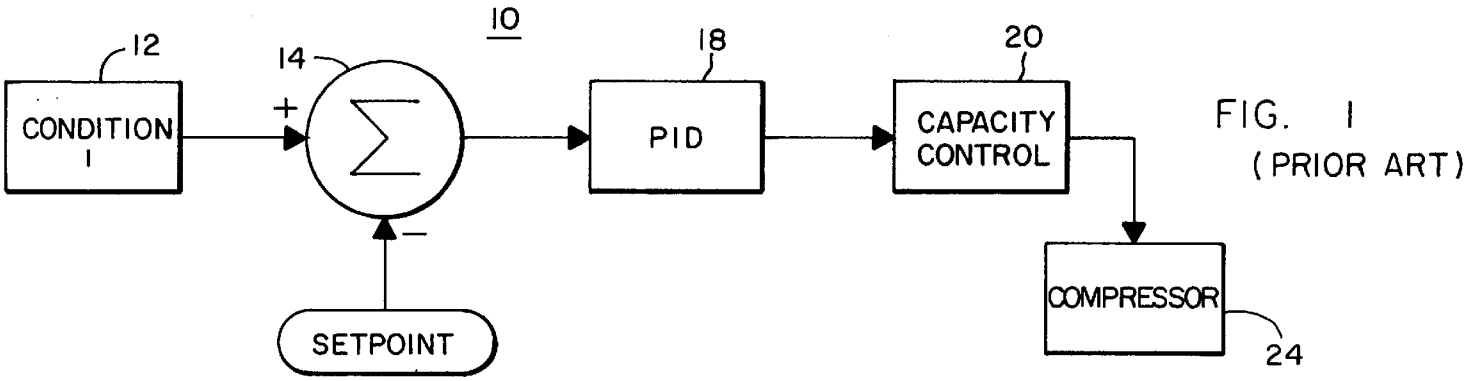
FIG. 1 (PRIOR ART)
FIG. 1 is a block diagram of a prior art compressor control system.

FIG. 1 shows a prior art compressor control system 10 in block diagram form. In this prior art system 10, a first condition is measured by a sensor as represented by block 12. This first condition may be air temperature in an air conditioning system, and may be a fluid temperature such as water in a chiller system. A comparator 14 compares the measured first condition to a first condition setpoint established in any conventional manner such as from RAM, from a building automation system or from a DIP switch. The comparator 14 derives a first condition error based on its comparison of the first condition with the first condition setpoint. This first condition error is passed to a PID calculator 18 using a proportional integral derivative (PID) algorithm that is conventional in nature and which provides a control signal used by a capacity controller 20 to maintain compressor capacity control of a compressor 24. Methods of controlling compressor capacity (particularly in screw compressors) are well known as shown by U.S. Pat. No. 4,042,310 to Schibbye et al.; U.S. Pat. No. 5,203,685 to Anderson et al.; U.S. Pat. No. 5,211,026 to Linnert et al. and U.S. Pat. No. 5,509,273 to Lakowske et al. The latter three of these patents are assigned to the assignee of the present invention, and the teachings of all of these patents are hereby incorporated by reference.

In these prior systems, a physical slide valve stop or puck was installed to prevent the slide valve from going below a compressor minimum capacity limit. As discussed previously, such a mechanical stop is not optimal.

Figure 2:
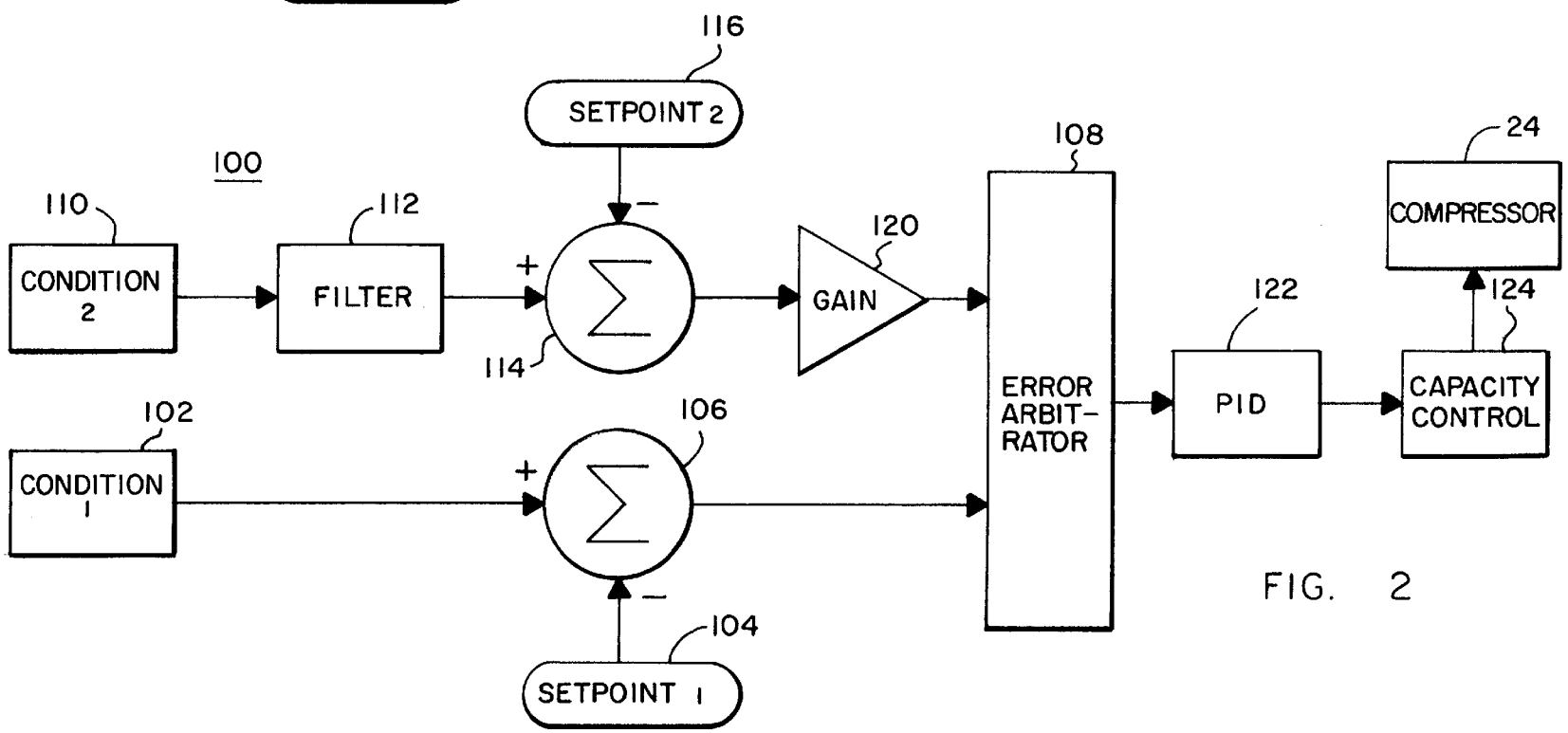
FIG. 2 is a block diagram of the compressor control system with a minimum capacity limit of the present invention.

FIG. 2 shows the present invention in block diagram form including a compressor control system 100.

Similarly to the system of FIG. 1, a first condition is by a sensor as indicated by block 102 and that measured first condition is compared to a first condition setpoint as provided by block 104, the first condition and the first condition setpoint being compared in a comparator 106 to determine a first condition error. The first condition error is forwarded to an error arbitrator 108 rather than directly to the PID calculator 18. This is a first significant difference from the previous systems.

Further differences include the measure of a second condition by a sensor as indicated by a block 110. This second condition is a measure of compressor rotor temperature. However, measuring compressor rotor temperature directly is difficult and an indirect measure is used that is a function of compressor rotor temperature. The preferred substitute measure is compressor refrigerant discharge temperature but alternative measures such as oil temperature or the differential refrigerant temperature across the compressor 22 are also contemplated.

The compressor refrigerant discharge temperature provided from the block 110 is filtered by a filter 112. Filtering of the compressor discharge temperature is necessary if an evaporator oil return system is used since the oil returned to the compressor 24 occurs on a fixed cycle and each oil return cycle depresses the refrigerant discharge temperature for a brief time. The filtered compressor refrigerant discharge temperature is forwarded to a comparator 114.

The comparator 114 also receives a second condition setpoint from a device 116 such as RAM memory, a DIP switch or any other conventional method of inputting such information. The comparator 114 determines a second condition error based upon the difference between the second condition as measured by compressor refrigerant discharge temperature and the second condition setpoint. The second condition error is forwarded from the comparator 114 to a gain block 120 which scales the second condition error to approximate the dynamics of the PID control block 122. The scaled second condition error is then forwarded to the error arbitrator 108.

The error arbitrator 108 compares the magnitude of the first condition error provided by the comparator 106 with the magnitude of the second condition error provided by the gain block 120. The larger error of these errors is passed to the PID control algorithm 122 and used conventionally by that PID algorithm to control compressor capacity as indicated by block 124.

The scaling in the gain block 120 is such that the error arbitrator 108 will preferably almost always pass the first condition error from the comparator 106 to the PID algorithm 122. Only combinations of low load, low evaporator temperatures and/or high condenser temperatures will increase the rotor temperature such that the compressor refrigerant discharged temperature begins to rise. As the compressor refrigerant discharge temperature rises, the resultant second condition error provided from the gain block 120 to the error arbitrator 108 will eventually exceed the first condition error provided by the comparator 106. In such an eventuality, the second condition error from the gain block 122 will be passed by the error arbitrator 108 to the PID algorithm for use in controlling compressor capacity. The use of the second condition error effectively prevents further unloading of the compressor 34 notwithstanding the signal provided from the comparator 106.

Figure 3:
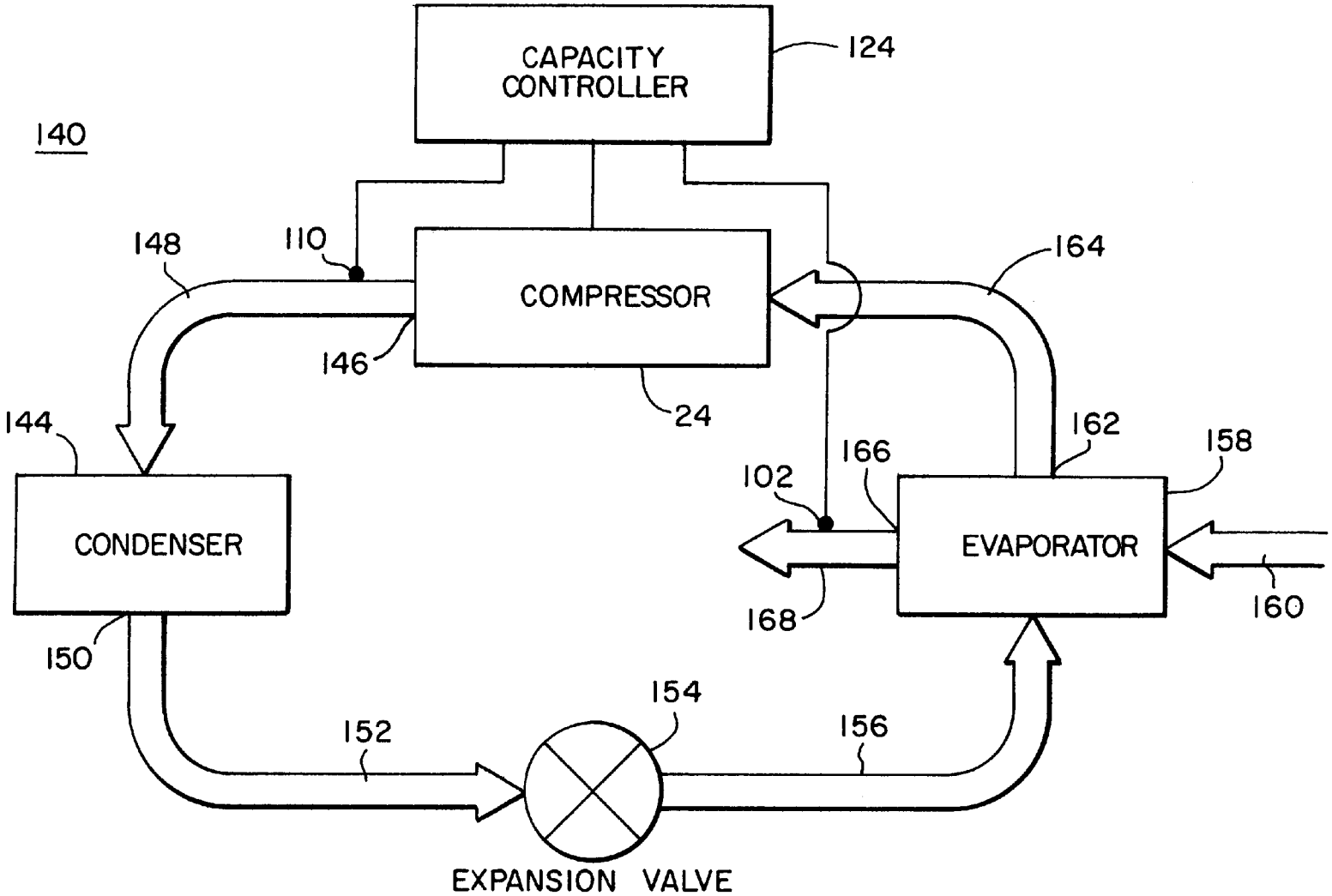
FIG. 3 is a block diagram of a system or process using the invention of FIG. 2.

FIG. 3 illustrates a process or system 140 implementing the invention as described in FIG. 2.

In FIG. 3, the capacity controller 124 controls the capacity of the compressor 24; the compressor 24 itself being a part of a refrigeration system 142. The refrigeration system 142 also includes a first heat exchanger 144 serially connected to an output 146 of the compressor 24 by a conduit 148. This first heat exchanger 144 functions as a condenser and has an outlet 150 directing refrigerant sequentially through a conduit 152, an expansion device 154, and a conduit 156 and ultimately to a second heat exchanger 158 functioning as an evaporator to extract heat from a process fluid 160. After extracting that heat, the refrigerant leaves the second heat exchanger 158 by an outlet 162 and is returned by conduit 164 to the compressor 24 to repeat the refrigeration cycle.

The cooled process fluid leaves the second heat exchanger 158 by an outlet 166 as indicated by the arrow 168. The temperature of the cooled process fluid 168 is measured by the first condition sensor 102 and is used as discussed in connection with FIG. 2. If the process fluid is air, the leaving air temperature is measured and the air is used to condition a space. If the process fluid is a liquid such as water, the leaving water (or fluid) temperature is measured by the first condition sensor 102 and the fluid is used as a heat transfer medium in, for example, a chiller system. The mechanics of such systems or processes 140 are further described in applicant's commonly assigned U.S. Pat. No. 5,632,154 to Sibik et al.; U.S. Pat. No. 5,600,960 to Schwedler et al.; and U.S. Pat. No. 5,419,146 to Sibik et al., all of which are hereby incorporated by reference.

The capacity controller 124 functions responsive to the greater error between temperature of the process fluid 168 as measured by the first condition 102 and its setpoint, and between the temperature of the compressor 24 doing the cooling as measured by the second condition 110 and its setpoint.

It is of course contemplated that various modifications and alterations of the present invention including the use of different control signals and different measures of rotor temperature will be seen as natural and apparent by persons of ordinary skill in the art. Additionally, a person of ordinary skill in the art recognizes that, although the present invention is given as an example in terms of a screw compressor water chiller system, that the invention will apply to all other system conditioning fluids whether those fluids are air or liquid. Other modifications and alterations are also readily apparent to a person of ordinary skill in the art. All such modifications and alterations are contemplated to fall within the spirit and scope of the present invention as set forth in the following claims.

What is claimed for Letters Patent of the United States is as follows:

1. A method of controlling compressor minimum capacity comprising the steps of:

measuring a first condition wherein the first condition is a measure of the temperature of a fluid being controlled;

comparing the first condition to a first setpoint to determine a first conditioned error;

modulating compressor capacity relative to the first condition error;

measuring a second condition wherein the second condition is a measure of the temperature of the compressor;

comparing the second condition to a second setpoint to determine a second condition error; and modulating compressor capacity relative to the second condition error if the magnitude of the second conditioned error is greater than the magnitude of the first conditioned error.

2. The method of claim 1 wherein the second condition is a function of the compressor rotor temperature.

3. The method of claim 2 wherein the second condition is a measure of compressor refrigerant discharge temperature.

4. The method of claim 3 wherein the first condition is a measure of leaving water temperature or leaving air temperature.

5. A method of controlling compressor capacity in a compressor having a rotor comprising the steps of:

measuring a temperature representative of the compressor rotor temperature;

comparing the measured temperature to a setpoint to determine a cooling error; and controlling the capacity of the compressor responsive to the magnitude of the cooling error.

6. The method of claim 5 wherein the measuring step includes the further step of measuring the temperature of fluid discharged by the compressor.

7. The method of claim 6 wherein the fluid discharged by the compressor is a cooling fluid used to condition the temperature of a process fluid and including the further steps of:

measuring a temperature representative of the process fluid;

comparing the measured process temperature to a process setpoint to determine a process error; and controlling the capacity of the compressor responsive to the magnitude of the process error if the process error is greater than or equal to the cooling error.

8. An HVAC or refrigeration system comprising:

a compressor operable to compress a cooling fluid;

a heat exchanger operably connected to the compressor to receive the cooling fluid and place the cooling fluid in heat exchange relationship with a process fluid; and a controller, operably connected to the compressor, and controlling the compressor capacity responsive to a first error associated with a first measured condition of the process fluid unless a second error associated with a second measured condition of the cooling fluid exceeds the first error; in such eventuality, the compressor capacity is modulated responsive to the second error.

9. The system of claim 8 wherein the second measured condition is a compressor refrigerant discharge temperature.

10. The system of claim 9 wherein the process fluid is a liquid such as water whose temperature is directly measured.

11. The system of claim 10 wherein the system is a chiller system.

12. An air conditioning or refrigeration system comprising:

a compressor having a variable capacity and a minimum capacity, and including an inlet and an outlet;

a condenser operably connected to the compressor outlet;

an expansion valve operably connected to the condenser;

an evaporator operably connected to the expansion valve and connected to the compressor inlet;

a first sensor operably associated with the evaporator and measuring the temperature of a first fluid being conditioned by the evaporator;

a second sensor associated with the compressor outlet and measuring a temperature representative of compressor refrigerant discharge temperature; and a controller, operably connected to the compressor and to the first and second sensors, for varying compressor capacity to maintain a predetermined temperature associated with the first fluid unless the compressor refrigerant discharge temperature measured by the second sensor indicates that the minimum compressor capacity will be violated whereupon the controller controls the compressor capacity response to the refrigerant discharge temperature.

* * * * *